United States Patent [19]

Ooms

[11] Patent Number: 4,897,573

[45] Date of Patent: Jan. 30, 1990

[54] ELECTRIC INCANDESCENT LAMP HAVING DISCHARGE ARC CONDUCTOR AND DISCHARGE ARC INTERRUPTION FUSE

[75] Inventor: Leo F. M. Ooms, Eindhoven, Netherlands

[73] Assignee: U.S. Philips Corporation, New York, N.Y.

[21] Appl. No.: 107,873

[22] Filed: Oct. 8, 1987

Related U.S. Application Data

[63] Continuation of Ser. No. 746,214, Jun. 18, 1985, abandoned.

[30] Foreign Application Priority Data

Jul. 3, 1984 [NL] Netherlands ..... 8402107

[51] Int. Cl.[4] ..... H01J 1/88

[52] U.S. Cl. ..... 313/273; 313/318; 313/274; 313/275; 315/91

[58] Field of Search ..... 313/318, 315, 273, 274, 313/275, 277; 315/91, 93, 119

[56] References Cited

U.S. PATENT DOCUMENTS

| | | | |
|---|---|---|---|
| 2,859,381 | 3/1956 | Gray et al. | 315/74 |
| 3,173,735 | 3/1965 | Fenn | 313/318 |
| 3,441,774 | 4/1969 | Stone et al. | 313/273 |
| 3,555,338 | 1/1971 | Scoledge | 313/315 |
| 3,796,914 | 3/1974 | De Caro et al. | 313/315 |
| 4,084,112 | 4/1978 | Hebert et al. | 313/318 |
| 4,278,916 | 7/1981 | Regan et al. | 315/91 |
| 4,574,217 | 3/1986 | Pendergrass | 313/318 |

FOREIGN PATENT DOCUMENTS 2050693 6/1979 United Kingdom .

*Primary Examiner*—Leo H. Boudreau
*Assistant Examiner*—Michael Razavi
*Attorney, Agent, or Firm*—Brian J. Wieghaus

[57] ABSTRACT

The electric incandescent lamp has a filament connected to current supply conductors and kept taut by a frame of longitudinal arc discharge conductors and transverse insulators. The arc discharge conductors are each connected to a point on the current supply conductors, at least one of them being connected through a arc discharge interruption fuse. When switching on and operating the lamp, the arc discharge interruption fuses and the arc discharge conductors are not included in the current circuit. The arc discharge conductors are positioned with respect to the filament so that upon formation of a discharge arc between fragments of the filament the arc flashes over to the arc discharge conductors. Only upon flash over of the arc to the arc discharge conductors does current flow through the arc discharge interruption fuse. The fuse interrupts the current and extinguishes the arc.

5 Claims, 1 Drawing Sheet

ELECTRIC INCANDESCENT LAMP HAVING DISCHARGE ARC CONDUCTOR AND DISCHARGE ARC INTERRUPTION FUSE

This is a continuation of application Ser. No. 746,214, filed June 18, 1985, now abandoned.

BACKGROUND OF THE INVENTION

The invention relates to an electric incandescent lamp comprising:

a translucent lamp vessel or envelope sealed in a vacuum-tight manner;

current supply conductors which enter the lamp vessel at a first end through its wall;

a frame having arc discharge conductors extending substantially longitudinally in the lamp vessel and insulators extending transversely thereto interconnecting these conductors;

a filament comprising several wound sections, which are kept taut beside each other by the frame, each end of this filament being connected towards the first end of the lamp vessel to a respective current supply conductor.

Such a lamp is known from British Patent Specification 2,050,693.

An incandescent lamp of this kind can be used inter alia for the illumination of photographic studios or film studios, as a theater lamp or as a projection lamp. The lamp is frequently a halogen incandescent lamp and is in this case provided with a lamp vessel of quartz glass or another glass having an $SiO_2$ content of at least 95% by weight and with a halogen-containing inert gas.

In such an incandescent lamp, a discharge arc can occur at the end of its life when the filament burns through. A high current then starts to flow through the lamp, which may lead to overheating of the lamp vessel, as a result of which the lamp explodes. In order to avoid explosion, the lamp is operated in series arrangement with a fuse which may be incorporated in the lamp and which interrupts, when it becomes operative, the current circuit through the lamp. In certain lamp types, the current through the lamp is smaller, however, (for example 80 A) upon the occurrence of a discharge arc than the high current (for example 100 A) transiently flowing when the lamp is switched on. Due to its short duration, this high transient current is not harmful, in contrast with the lower arc current if it is of fairly long duration. This lower arc current renders it very difficult to choose a fuse which becomes operative at this lower arc current and does not become operative at the higher transient current.

SUMMARY OF THE INVENTION

The invention has for its object to provide a lamp design which protects the lamp from explosion due to a discharge arc and nevertheless permits a transient current which is higher than the arc current.

According to the invention, this object is achieved in a lamp of the kind described in the opening paragraph in that the arc discharge conductors of the frame are electrically connected to a point on a respective current supply conductor, at least one of the arc discharge conductors of the frame being connected to this point on the respective current supply conductor via a fuse.

During the life of the lamp, a current circuit is formed in the lamp by a first current supply conductor, the first end of the filament connected thereto, the filament, the second end of the filament and the second current supply conductor connected to this second end. The two arc discharge conductors of the frame and the fuse do not form part of this circuit. The transient current therefore does not flow through the fuse. Nevertheless the same potential is applied across the arc discharge conductors of the frame as across the filament.

Lamps of the kind described are generally operated in a vertical position with the first end of the lamp vessel, through which the current supply conductors enter, located on the lower side. When the filament of the lamp burns through, a discharge arc is produced between the fragments of the filament. The length of this discharge arc increases and this arc assumes under the influence of convection currents a form curved upwards. The discharge arc then readily flashes over to the conductors of the frame. Another current circuit is then formed in the lamp: first current supply conductor, fuse, first arc discharge conductor of the frame, discharge arc, second arc discharge conductor of the frame, second current supply conductor. Consequently, the fuse is included in this second current circuit, whereas it is not included in the first current circuit through which current passes when switching on the lamp and during normal operation.

In the lamp according to the invention, the dimensioning of the fuse can be fully adapted to the purpose for which the fuse is used, i.e. to achieve a rapid interruption of the current through the lamp when a discharge arc is produced. Very high transient currents need not be taken into account. Therefore, it is easy for those skilled in the art to choose a correct fuse for a given lamp type with a few test lamps. If a fuse acting too rapidly should be used, a discharge arc could again be produced between the fragments of the filament after this fuse had become operative. Thus, it has been found that in a studio lamp (110 V, 2000 W, color temperature 3200 K.) a fuse of tungsten wire having a diameter of 160 $\mu$m acted too rapidly and a discharge arc was produced again. A tungsten wire having a diameter of 300 $\mu$m yielded very satisfactory results in the same lamp. The fuse acted so slowly that a reignition of the discharge arc across the filament fragments no longer occurred, whereas on the other hand it acted sufficiently rapidly that 10 ms after the production of the discharge arc, current no longer flowed through the lamp. In an embodiment of the lamp according to the invention, both arc discharge conductors of the frame are connected through a fuse to a respective current supply conductor.

In a favorable embodiment, the arc discharge conductors of the frame are located at least at their ends remote from the first end of the lamp vessel closer to each other than the extreme sections of the filament. The electric field strength between these conductors is then great in situ, as a result of which the discharge arc flashes over very readily to these conductors. Alternatively, the arc discharge conductors do not have to be part of the frame. Other means could be used to support the filament. Each arc discharge conductor can have one end connected to a current-supply conductor and an unconnected free end, or other portion, which is proximate the filament for facilitating arc transfer to the arc discharge conductors. The lamp can be a halogen lamp and can consequently have a halogen-containing gas filling.

BRIEF DESCRIPTION OF THE DRAWINGS

An embodiment of the lamp according to the invention is shown in the accompanying drawing. In the drawing.

DESCRIPTION OF THE PREFERRED EMBODIMENT

Figure 1:
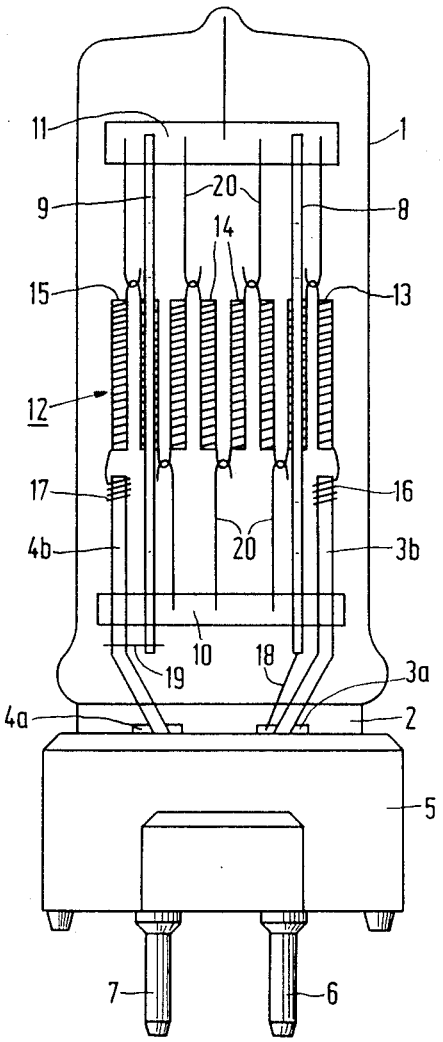
FIG. 1 shows an embodiment in side elevation.
Figure 2:
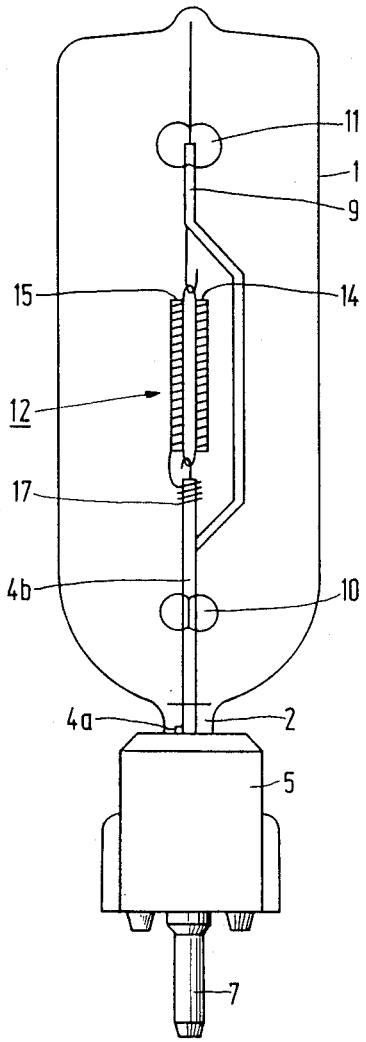
FIG. 2 shows the lamp of FIG. 1 in side elevation rotated through 90°.

In the Figures, the lamp has a quartz glass lamp vessel or envelope 1, which is sealed in a vacuum-tight manner and has at a first end 2 a pinch through which current supply conductors *3a, 3b, 4a,* and *4b* enter the lamp vessel 1. The current supply conductors each comprise a metal foil *3a* and *4a,* respectively, and a tungsten wire *3b* and *4b,* respectively, welded thereto. The first end 2 of the lamp vessel has secured to it a lamp cap 5 provided with contact pins 6 and 7, to which the current supply conductors *3a, 3b* and *4a, 4b,* respectively, are connected. The tungsten wires *3b, 4b* could alternatively extend outside the lamp vessel, however.

Inside the lamp vessel 1 substantially longitudinally extending arc discharge conductors 8, 9 of tungsten wire and transversely extending insulators 10, 11 of quartz glass interconnecting the conductors 8, 9 constitute a frame 8, 9, 10, 11, which keeps a filament 12 taut. The filament 12 comprises a number of sections 13, 14, 15 taut beside each other, of which 13 and 15 form the extreme sections. The sections 13, 14, 15 are alternately arranged in first and second planes so that the filament 12, as shown in the Figures, is of the bipolar type. However, the sections 13, 14, 15 could alternatively be arranged in one plane and could thus form a monoplanar filament. Hooks 20 keep the filament 12 connected to the insulators 10, 11 of the frame 8, 9, 10, 11.

Towards the first end 2 of the lamp vessel 1, the ends 16 and 17 of the filament are connected to the current supply conductors *3b* and *4b,* respectively.

The arc discharge conductors 8, 9 of the frame 8, 9, 10, 11 in the embodiment shown are electrically connected to a point on the current supply conductors *3a* and *4b,* respectively, in both cases via a fuse 18 and 19, respectively. In general, if the lamp according to the invention has two fuses for connecting the conductors of the frame to the current supply conductors, a similar point of the current supply conductors will be chosen to connect a respective fuse thereto.

When the lamp is switched on and operated, the current circuit is formed by the elements *3a, 3b,* 16, 13, 14, 15, 17, *4b, 4a.* A fuse is not provided therein. The current circuit consequently cannot be interrupted due to a very high, but transient and hence harmless switching-on current. When the filament 12 melts during operation of the lamp, for example, at one of the sections designated by 14, a discharge arc is produced in situ, which causes a high current to flow. The voltage across the discharge arc is only part of the voltage applied across the current supply conductors *3a, 3b; 4a, 4b* because the arc is connected in series with the fragments of the filament 12. Due to convection currents, the discharge arc is curved upwards, i.e. in the normal operating position, towards the insulator 11. The full voltage applied across the current supply conductors *3a, 3b; 4a, 4b* is supplied to the arc discharge conductors 8, 9 of the frame 8, 9, 10, 11. In the embodiment shown, in which the conductors 8, 9 are located closer to each other than the extreme sections 13, 15 of the filament 12, the electric field strength between these conductors 8, 9 is greater than between the extreme filament sections. Due to the fact that the discharge arc causes the fragments of the filament gradually to melt further and due to the fact that the arc is curved, the length of the arc very soon becomes larger than the distance between the conductors 8 and 9. The discharge arc then flashes over to these conductors 8, 9, as a result of which the current circuit through the lamp comprises the elements *3a,* 18, 8, (discharge arc), 9, 19, *4b, 4a.* In this current circuit, the fuses 18, 19 are indeed included. Without taking into account higher transient currents, these fuses can be dimensioned for the purpose for which they are intended: interruption of an arc current. When in a 2000 W—110 V halogen theatre lamp of the kind shown tungsten wires of 300 μm were chosen for the fuses, the current through the lamp was ultimately interrupted within 10 ms after the production of the discharge arc. The fuses therefore were sufficiently slow-acting to prevent a reignition of the arc. Instead of bare fuses, enveloped fuse wires may be used.

What is claimed is:

1. An electric incandescent lamp, comprising:

(a) a lamp envelope;

(b) current-supply conductors which enter said lamp envelope;

(c) a filament within said lamp envelope, each end of the filament being electrically connected to a respective current supply conductor to permit lamp operating current to flow through said filament;

(d) an arc discharge interruption fuse; and (e) an arc discharge conductor within said lamp envelope having one end electrically connected in series with said arc discharge interruption fuse to a current supply conductor, said arc discharge conductor being spaced and electrically isolated from said filament whereby lamp operating current does not flow in said arc discharge conductor and does not flow in said arc discharge interruption fuse during normal lamp operation, said arc discharge conductor having a portion proximate said filament for facilitating arc transfer from said filament to said arc discharge conductor upon occurrence of a destructive arc between portions of said filament, such that the arc jumps to said arc discharge conductor and an arc current then flows through said arc discharge interruption fuse which opens in response to the arc current thereby interrupting the arc current and extinguishing the arc.

2. An electric incandescent lamp, comprising:

(a) a lamp envelope;

(b) current-supply conductors which enter said lamp envelope;

(c) a filament within said lamp envelope, each end of said filament being electrically connected to a respective current supply conductor to permit lamp operating current to flow through said filament;

(d) a plurality of arc discharge interruption fuses;

(e) a plurality of arc discharge conductors within said lamp envelope, said arc discharge conductors being spaced and electrically isolated from said filament whereby lamp operating current does not flow through said arc discharge conductors and does not flow through said arc discharge fuses during normal lamp operation, each said arc discharge conductor having one end electrically connected in series with a corresponding one of said arc discharge interruption fuses to a corresponding current-supply conductor, and said arc discharge conductors each having a respective free end, a portion of each said arc discharge conductor being proximate said filament for facilitating arc transfer from said filament to an arc discharge conductor upon occurrence of a destructive arc between portions of the filament, such that the arc jumps to said discharge conductors and an arc current then flows through an arc discharge interruption fuse which opens in response to the arc current thereby interrupting the arc current and extinguishing the arc.

3. The incandescent lamp as claimed in claim 2, wherein said filament is comprised of filament segments disposed in a planar array, said array of segments having a width dimension bounded by outermost filament segments, and said free ends of said arc discharge conductors being spaced closer than the width of said array.

4. An electric incandescent lamp, comprising:

(a) a translucent lamp envelope sealed in a vacuum-tight manner and having an end wall, the envelope having a length dimension along the longitudinal axis of said envelope;

(b) current supply conductors which enter the lamp vessel through said end wall;

(c) a plurality of arc discharge interruption fuses;

(d) a filament comprised of filament segments disposed in a planar array, said planar array having a width dimension bounded by outermost filament segments, said width dimension being substantially perpendicular to the longitudinal axis of said lamp envelope, said planar array having a length dimension substantially parallel to the longitudinal axis, each end of said filament being electrically connected to a respective current supply conductor so that lamp operating current flows through the filament;

(e) a frame comprising a plurality of arc discharge conductors extending substantially longitudinally in said lamp envelope and insulating members extending substantially transversely to said arc discharge conductors and interconnecting said arc discharge conductors, each said arc discharge conductor having a first end electrically connected in series with a corresponding arc discharge fuse to a corresponding current supply conductor, each arc discharge conductor having a second end which is further away from said end wall than said first end of said arc discharge conductor;

(f) means for connecting said segments of said filament array to said transverse insulating member so that said segments remain substantially taut during lamp operation; and (g) said arc discharge conductors are spaced and electrically isolated from said filament whereby lamp operating current does not flow through said arc discharge conductors and does not flow through said arc discharge fuses during normal lamp operation, said second ends of said arc discharge conductors are located within an area described by a circle centered on the longitudinal axis of said lamp envelope which circumscribes the outermost filament segment of said filament arrays, such that upon occurrence of a destructive arc between portions of said filament, the arc transfers to said arc conductors and an arc current then flows through an arc discharge interruption fuse which opens in response to the arc current thereby interrupting the arc current and extinguishing the arc, said insulating members being positioned away from said filament a sufficient distance to allow sufficient arching of the arc to facilitate transfer of the arc to said arc discharge conductors, and said arc discharge fuses are sufficiently slow acting to prevent reignition of the arc between positions of the filament.

5. A lamp as claimed in claim 4, wherein:

the number of said arc discharge conductors is two and the number of said arc discharge fuses is two, said filament comprises filament segments disposed in a plurality of planar arrays, said arrays being substantially parallel to each other and to said frame, said filament having a length dimension corresponding to the longest of said arrays and having a width dimension corresponding to the widest of said arrays, each said arc discharge conductor has a portion extending substantially the length of said filament, each said conductor portion being located within an area described by an imaginary circle centered on the longitudinal axis of said lamp envelope which circumscribes the outermost filament segment of said planar arrays, each said portion extending substantially the length of said filament, and both of said portions lie in a plane which is substantially parallel to said planar arrays and which is more distant from said longitudinal axis of said lamp envelope than any planar array.

* * * * *